US006380903B1

(12) United States Patent
Hayes et al.

(10) Patent No.: US 6,380,903 B1
(45) Date of Patent: Apr. 30, 2002

(54) ANTENNA SYSTEMS INCLUDING INTERNAL PLANAR INVERTED-F ANTENNAS COUPLED WITH RETRACTABLE ANTENNAS AND WIRELESS COMMUNICATORS INCORPORATING SAME

(75) Inventors: Gerard James Hayes, Wake Forest; Robert Sadler, Raleigh, both of NC (US)

(73) Assignee: Telefonaktiebolaget L.M. Ericsson, Stockholm (SE)

( * ) Notice: Subject to any disclaimer, the term of this patent is extended or adjusted under 35 U.S.C. 154(b) by 0 days.

(21) Appl. No.: 09/785,822

(22) Filed: Feb. 16, 2001

(51) Int. Cl.[7] ..... H01Q 21/00

(52) U.S. Cl. ..... 343/725; 343/700 MS; 343/702

(58) Field of Search ..... 343/700 MS, 702, 343/725, 829, 846, 895, 901; H01Q 1/24, 1/38, 21/00

(56) References Cited

U.S. PATENT DOCUMENTS 5,530,919 A * 6/1996 Tsuru et al. ..... 455/90
6,211,830 B1 * 4/2001 Monma et al. ..... 343/702
6,255,951 B1 * 5/2001 Holshouser et al. . 343/700 MS
6,252,554 B1 * 6/2001 Isohatala et al. ..... 343/700 MS

* cited by examiner

*Primary Examiner*—T Phan
(74) *Attorney, Agent, or Firm*—Myers Bigel Sibley & Sajovec

(57) ABSTRACT

Antenna systems for use with wireless communicators, such as radiotelephones, are provided and include a first antenna configured to be internally mounted within a wireless communicator and a retractable, second antenna that couples with the first antenna when extended. The internal, first antenna is resonant within one or more frequency bands and the retractable, second antenna couples with the internal, first antenna so as to enhance one or more of the resonant frequency bands of the internal, first antenna.

7 Claims, 6 Drawing Sheets

ANTENNA SYSTEMS INCLUDING INTERNAL PLANAR INVERTED-F ANTENNAS COUPLED WITH RETRACTABLE ANTENNAS AND WIRELESS COMMUNICATORS INCORPORATING SAME

FIELD OF THE INVENTION

The present invention relates generally to antennas, and more particularly to antennas used with wireless communicators.

BACKGROUND OF THE INVENTION

Radiotelephones generally refer to communications terminals which provide a wireless communications link to one or more other communications terminals. Radiotelephones may be used in a variety of different applications, including cellular telephone, land-mobile (e.g., police and fire departments), and satellite communications systems. Radiotelephones typically include an antenna for transmitting and/or receiving wireless communications signals.

Radiotelephones and other wireless communicators are undergoing miniaturization. Indeed, many contemporary radiotelephones are less than 11 centimeters in length. As a result, there is increasing interest in small antennas that can be utilized as internally-mounted antennas for radiotelephones.

Inverted-F antennas may be well suited for use within the confines of radiotelephones, particularly radiotelephones undergoing miniaturization. As is well known to those having skill in the art, conventional inverted-F antennas include a conductive element that is maintained in spaced apart relationship with a ground plane. Exemplary inverted-F antennas are described in U.S. Pat. Nos. 5,684,492 and 5,434,579 which are incorporated herein by reference in their entirety.

In addition, it may be desirable for radiotelephones to operate within multiple frequency bands in order to utilize more than one communications system. For example, GSM (Global System for Mobile communication) is a digital mobile telephone system that typically operates at a low frequency band, such as between 880 MHz and 960 MHz. DCS (Digital Communications System) is a digital mobile telephone system that typically operates at high frequency bands, such as between 1710 MHz and 1880 MHz. The frequency bands allocated in North America are 824–894 MHz for Advanced Mobile Phone Service (AMPS) and 1850–1990 MHz for Personal Communication Services (PCS). Accordingly, internal antennas, such as inverted-F antennas are being developed for operation within multiple frequency bands.

There is also interest in utilizing retractable antennas that-can be extended from communications devices, such as radiotelephones. Retractable antennas may enhance signal transmission and reception, particularly in communications devices utilizing code-division multiple access (CDMA) wireless telephone transmission technologies. Some conventional wireless communicators, such as radiotelephones, utilize a one-quarter wavelength whip antenna in combination with a one-quarter wavelength stub antenna. When extended, the whip antenna combines with the stub antenna to provide one-half wavelength performance. When the whip antenna is retracted, the stub antenna provides one-quarter wavelength performance.

Unfortunately, communications devices that utilize retractable/internal antenna combinations and retractable/stub antenna combinations may require complex switching schemes which, in turn, may increase manufacturing costs and may present reliability concerns. Moreover, dual-band retractable antennas having one-half wavelength performance may be unavailable without impedance matching circuitry.

SUMMARY OF THE INVENTION

In view of the above discussion, antenna systems for use within wireless communicators, such as radiotelephones, according to embodiments of the present invention, include a first antenna configured to be internally mounted within a wireless communicator and a retractable, second antenna that electrically couples with the first, internal antenna when the retractable, second antenna is extended. The internal, first antenna may be resonant within one or more frequency bands and the retractable, second antenna is configured to couple with the internal, first antenna so as to enhance one or more of the resonant frequency bands. When in the extended position, the retractable, second antenna may be parasitically coupled with the internal, first antenna, or may be directly connected to the internal, first antenna.

According to embodiments of the present invention, the internal, first antenna is an inverted-F antenna. The retractable, second antenna, according to embodiments of the present invention, includes a one-quarter wavelength whip portion with a one-quarter wavelength helix antenna at a free end thereof. The helix antenna is physically connected to the whip portion, but may be electrically connected to, coupled to, or isolated from the chip antenna.

Antenna systems according to the present invention may be particularly well suited for use within wireless communicators, such as radiotelephones, wherein space limitations may limit the performance of internally mounted antennas. The combination of a retractable, second antenna with an internal inverted-F antenna according to embodiments of the present invention may enhance the performance of the internal inverted-F antenna when the retractable, second antenna is extended. Furthermore, the combination of internal and retractable antennas according to embodiments of the present invention may not require impedance matching networks, which may save internal radiotelephone space and which may lead to manufacturing cost savings.

BRIEF DESCRIPTION OF THE DRAWINGS

FIG. 4A illustrates the retractable second antenna in a retracted position, and FIG. 4B illustrates the retractable second antenna in an extended position.

DETAILED DESCRIPTION OF THE INVENTION

Figures 1, 2:
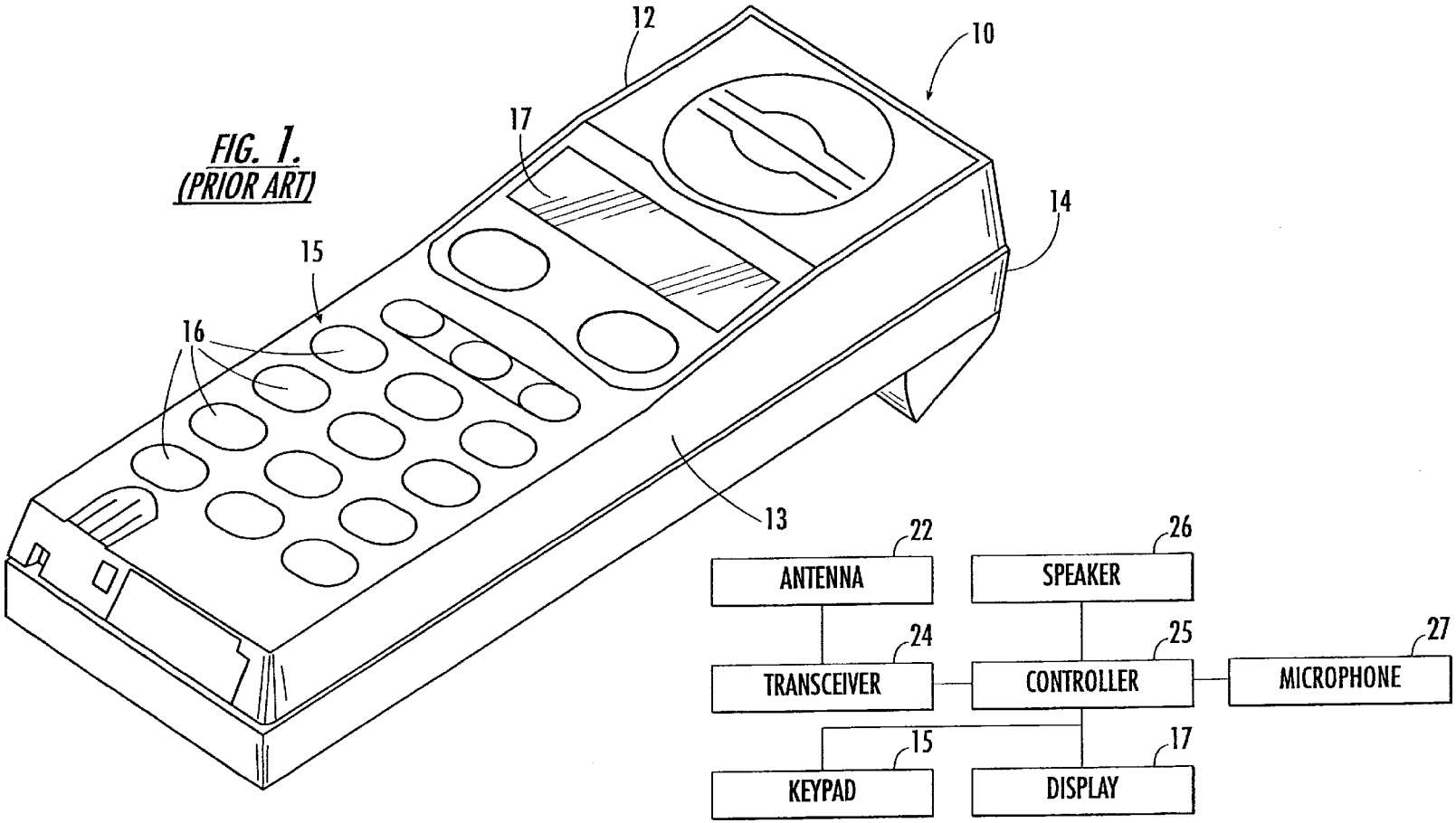
FIG. 1. (PRIOR ART)
FIG. 2. (PRIOR ART)
FIG. 1 is a perspective view of an exemplary radiotelephone within which antenna systems according to the present invention may be incorporated.
FIG. 2 is a schematic illustration of a conventional arrangement of electronic components for enabling a radiotelephone to transmit and receive telecommunications signals.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, the thickness of lines, layers and regions may be exaggerated for clarity. It will be understood that when an element such as a layer, region or substrate is referred to as being "on" another element, it can be directly on the other element or intervening elements may also be present. In contrast, when an element is referred to as being "directly on" another element, there are no intervening elements present. It will be understood that when an element is referred to as being "connected" to another element, it can be directly connected to the other element or intervening elements may also be present. In contrast, when an element is referred to as being "directly connected" to another element, there are no intervening elements present.

Referring now to FIG. 1, a wireless communicator (e.g., a radiotelephone) 10, within which antenna systems according to various embodiments of the present invention may be incorporated, is illustrated. The housing 12 of the illustrated radiotelephone 10 includes a top portion 13 and a bottom portion 14 connected thereto to form a cavity therein. Top and bottom housing portions 13, 14 house a keypad 15 including a plurality of keys 16, a display 17, and electronic components (not shown) that enable the radiotelephone 10 to transmit and receive radiotelephone communications signals.

It is understood that antenna systems according to the present invention may be utilized within various types of wireless communicators and are not limited to radiotelephones. Antenna systems according to the present invention may also be used with wireless communicators which only transmit or receive wireless communications signals. Such devices which only receive signals may include conventional AM/FM radios or any receiver utilizing an antenna. Devices which only transmit signals may include remote data input devices.

A conventional arrangement of electronic components that enable a radiotelephone to transmit and receive radiotelephone communication signals is shown schematically in FIG. 2, and is understood by those skilled in the art of radiotelephone communications. An antenna 22 for receiving and transmitting radiotelephone communication signals is electrically connected to a radio-frequency (RF) transceiver 24 that is further electrically connected to a controller 25, such as a microprocessor. The controller 25 is electrically connected to a speaker 26 that transmits a remote signal from the controller 25 to a user of a radiotelephone. The controller 25 is also electrically connected to a microphone 27 that receives a voice signal from a user and transmits the voice signal through the controller 25 and transceiver 24 to a remote device. The controller 25 is electrically connected to a keypad 15 and display 17 that facilitate radiotelephone operation.

As is known to those skilled in the art of communications devices, an antenna is a device for transmitting and/or receiving electrical signals. On transmission, an antenna accepts energy from a transmission line and radiates this energy into space. On reception, an antenna gathers energy from an incident wave and sends this energy down a transmission line. The amount of power radiated from or received by an antenna typically is described in terms of gain.

Radiation patterns for antennas are often plotted using polar coordinates. Voltage Standing Wave Ratio (VSWR) relates to the impedance match of an antenna feed point with a feed line or transmission line of a communications device, such as a radiotelephone. To radiate radio frequency energy with minimum loss, or to pass along received RF energy to a radiotelephone receiver with minimum loss, the impedance of a radiotelephone antenna is conventionally matched to the impedance of a transmission line or feed point.

Conventional radiotelephones typically employ an antenna which is electrically connected to a transceiver operably associated with a signal processing circuit positioned on an internally disposed printed circuit board. In order to maximize power transfer between an antenna and a transceiver, the transceiver and the antenna are preferably interconnected such that their respective impedances are substantially "matched," i.e., electrically tuned to compensate for undesired antenna impedance components to provide a 50 Ohm (Ω) (or desired) impedance value at the feed point.

Figure 3A:
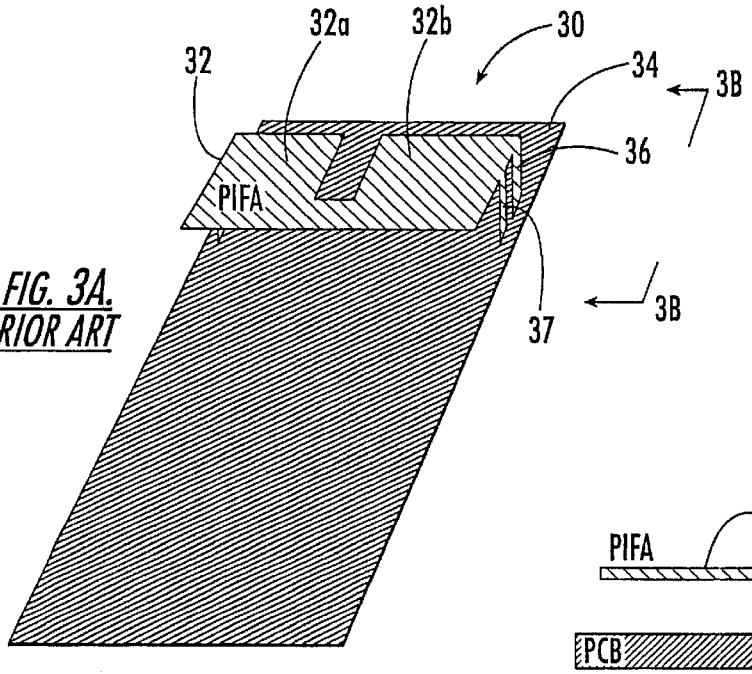
FIG. 3A. PRIOR ART
FIG. 3A is a perspective view of a conventional planar inverted-F antenna.
Figure 3B:
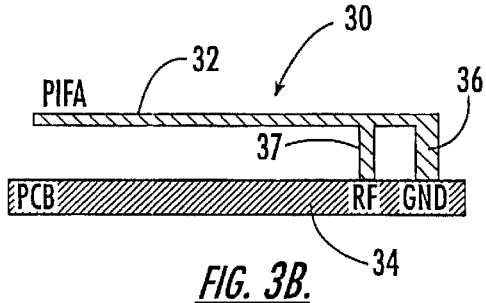
FIG. 3B. PRIOR ART
FIG. 3B is a side view of the conventional planar inverted-F antenna of FIG. 3A taken along lines 3B—3B.

Referring now to FIGS. 3A and 3B, a conventional inverted-F antenna 30 configured for use in a radiotelephone is illustrated. FIG. 3A is a perspective view of the inverted-F antenna 30 and FIG. 3B is a side view taken along lines 3B—3B in FIG. 3A. Conventional inverted-F antennas, such as the one illustrated in FIGS. 3A–3B, derive their name from their resemblance to the letter "F."

The illustrated antenna 30 includes a conductive element 32 maintained in spaced apart relationship with a ground plane 34. The illustrated conductive element 32 has first and second portions or branches 32*a*, 32*b*, which may be resonant in different respective frequency bands, as would be understood by those skilled in the art. The conductive element 32 is grounded to the ground plane 34 via a ground feed 36. A signal feed 37 extends from a signal receiver and/or transmitter (e.g., an RF transceiver) underlying or overlying the ground plane 34 to the conductive element 32, as would be understood by those of skill in the art.

Figure 4A:
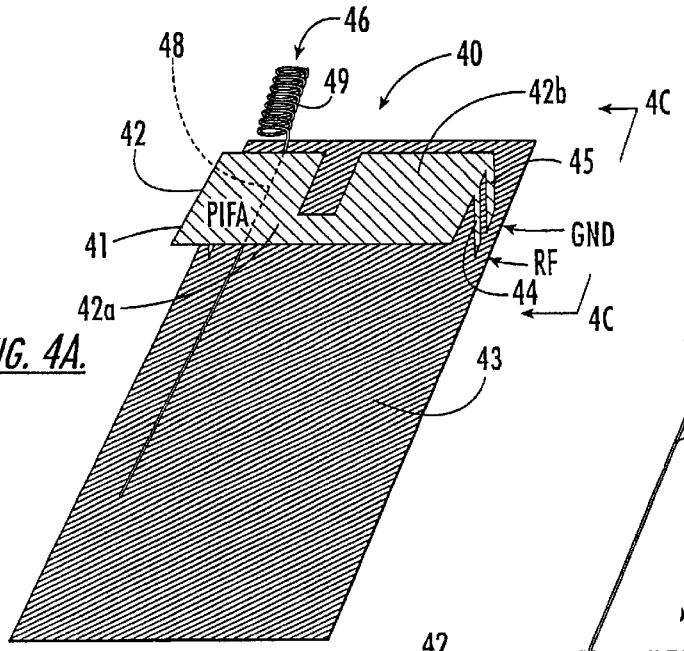
FIGS. 4A–4B are perspective views of an antenna system according to embodiments of the present invention wherein a retractable second antenna is configured to couple with an internal inverted-F antenna.
Figure 4B:
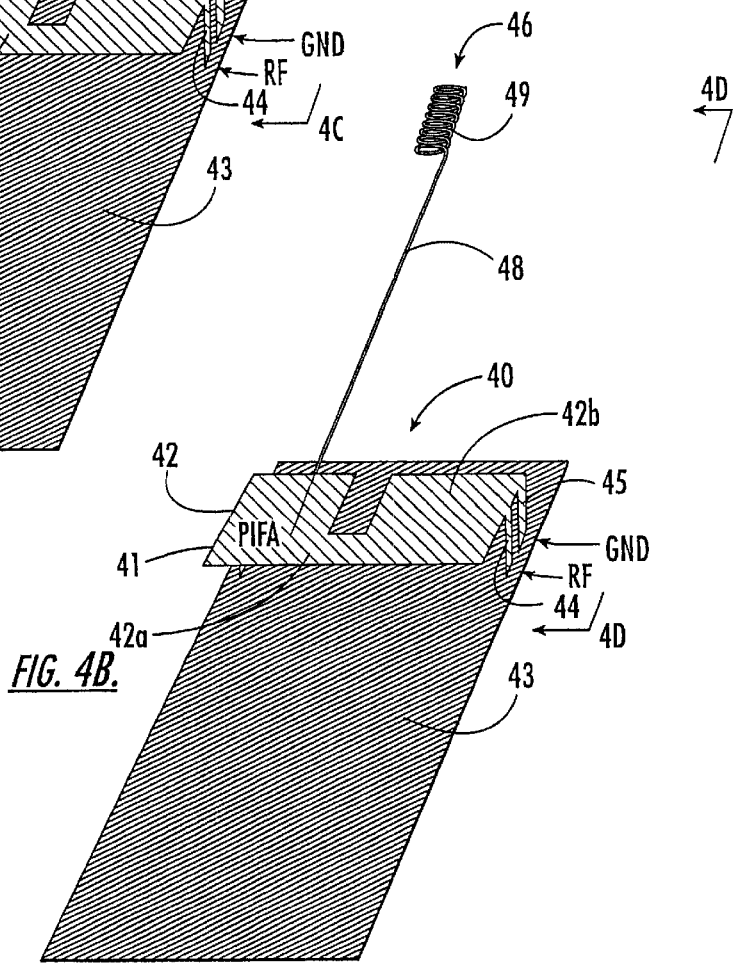
Figure 4C:
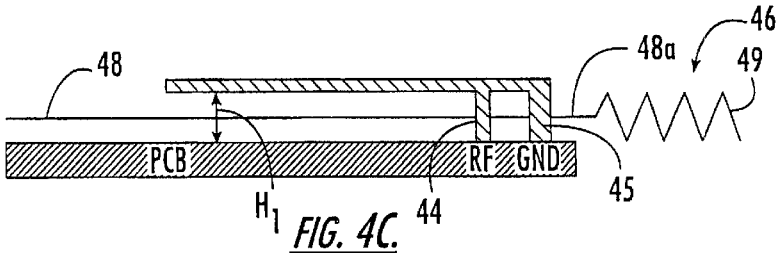
FIG. 4C is a side view of the antenna system of FIG. 4A taken along lines 4C—4C.
Figure 4D:
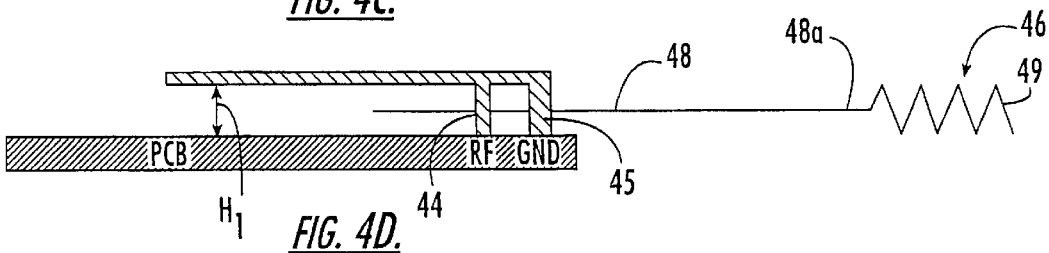
FIG. 4D is a side view of the antenna system of FIG. 4B taken along lines 4D—4D.

Referring now to FIGS. 4A–4D, an antenna system 40, according to embodiments of the present invention, that is configured for use with various wireless communicators, such as radiotelephones, is illustrated. As illustrated, the antenna system 40 includes an inverted-F antenna 41 that is configured to be internally mounted within a wireless communicator, such as a radiotelephone, and a retractable, second antenna 46. The retractable, second antenna 46 may be externally or internally mounted. FIG. 4A is a perspective view of the antenna system 40 with the retractable, second antenna 46 in a retracted position, and FIG. 4B is a perspective view of the antenna system 40 with the retractable, second antenna 46 in an extended position. FIG. 4C is a side elevation view of the antenna system 40 of FIG. 4A taken along lines 4C—4C. FIG. 4D is a side elevation view of the antenna system 40 of FIG. 4B taken along lines 4D—4D.

The illustrated inverted-F antenna 41 includes a conductive element 42 having first and second branches 42*a*, 42*b*. The first branch 42*a* may be resonant within a first frequency band and the second branch 42*b* may be resonant within a second frequency band different from the first frequency band. The first frequency band may be a low frequency band and the second frequency band may be a high frequency band, or vice-versa, as would be understood by those of skill in the art. For example, a frequency band of one of the branches 42*a*, 42*b* may be between 824 MHz and 960 MHz (i.e., a low frequency band) and a frequency band of the other one of the branches 42*a*, 42*b* may be between 1710 MHz and 1990 MHz (i.e., a high frequency band).

In the illustrated embodiment, each branch 42*a*, 42*b* of the conductive element 42 is maintained in adjacent, spaced-apart relationship with a ground plane 43 (e.g., a printed circuit board and/or shield can overlying a printed circuit board) that is also disposed within a wireless communicator. The branches 42*a*, 42*b* of the conductive element 42 typically are maintained spaced-apart from the ground plane 43 by a distance H, (FIGS. 4C–4D), which may be as large as possible, but typically between about 4 millimeters (mm) and about 12 mm.

A signal feed 44 is electrically connected to the conductive element 42 and extends outwardly therefrom to electrically connect the inverted-F antenna 41 to a wireless communications signal receiver and/or transmitter (not shown). A ground feed 45 also extends outwardly from the conductive element 42 adjacent the signal feed 44 and grounds the inverted-F antenna 41, for example, via the ground plane 43.

As would be understood by those of skill in the art, the conductive element of an inverted-F antenna, according to embodiments of the present invention, may be formed on a dielectric substrate (e.g., FR4, polyimide), for example by etching a metal layer or layers in a pattern on the dielectric substrate. Also, as would be understood by those of skill in the art, an inverted-F antenna, according to embodiments of the present invention, may have any number of conductive elements disposed on and/or within a dielectric substrate.

A preferred conductive material out of which the conductive element 42 of the illustrated inverted-F antenna 41 may be formed is copper. For example, the conductive element branches 42*a*, 42*b* may be formed from copper sheet. Alternatively, the conductive element branches 42*a*, 42*b* may be formed from a copper layer on a dielectric substrate. However, conductive element branches 42*a*, 42*b* for inverted-F antennas according to the present invention may be formed from various conductive materials and are not limited to copper.

An inverted-F antenna that may be utilized in an antenna system 40, according to embodiments of the present invention, may have various shapes, configurations, and sizes. The present invention is not limited to the illustrated configuration of the inverted-F antenna 41 of FIGS. 4A–4D. Moreover, the present invention is not limited to inverted-F antennas having two branches. Inverted-F antennas utilized in embodiments of the present invention may have one or more radiating portions or branches. Exemplary inverted-F antenna shapes and configurations are described and illustrated in a co-pending and co-assigned U.S. patent application entitled: "Inverted-F Antennas With Multiple Planar Radiating Elements And Wireless Communicators Incorporating Same", Ser. No. 09/542,616, filed Apr. 4, 2000, which is incorporated herein by reference in its entirety.

The retractable, second antenna 46 is configured to electrically couple with the inverted-F antenna 41 when extended (FIGS. 4B and 4D). As would be known by one of skill in the art, the term "coupling" refers to the association of two or more circuits or elements in such a way that power or signal information may be transferred from one to another. The second antenna 46 in the antenna system 40 is configured to enhance at least one resonant frequency band of the internal inverted-F antenna 41. The term "enhance" includes improving either VSWR performance or radiation performance or both. The term "enhance" also includes changing a resonant frequency band of an antenna to a preferred operating band.

The second antenna 46 may be parasitically coupled with the inverted-F antenna 41 (i.e., there is no direct connection between the second antenna 46 and the inverted-F antenna 41) when extended. Alternatively, the second antenna 46 may be directly connected with the inverted-F antenna 41 when extended.

In the illustrated embodiment, the retractable, second antenna 46 includes a linear rod 48 (i.e., a "whip portion") having a free end 48*a*. Mounted at the free end 48*a* of the linear rod 48 is a helix antenna 49. One end of the helix antenna 49 is free-standing and other end is electrically connected to the linear rod 48. As is understood by those of skill in the art, helix antennas are antennas which include a conducting member wound in a helical pattern. As the conducting member is wound about an axis, the axial length of a quarter-wavelength or half-wavelength helix antenna can be considerably less than the length of a comparable quarter-wavelength monopole antenna, thus, helix antennas may be employed where the length of a quarter-wavelength monopole antenna is prohibitive. Moreover, although a half-wavelength or a quarter-wavelength helix antenna is typically considerably shorter than its half-wavelength or quarter-wavelength monopole antenna counterpart, it may exhibit the same effective electrical length.

The helix antenna 49 is physically connected to the linear rod 48, but may be electrically connected to, coupled to, or isolated from the linear rod 48. According to embodiments of the present invention, the helix antenna 49 may be a dual-frequency band helix antenna. Dual-frequency band helix antennas are described in U.S. Pat. No. 5,923,305, which is incorporated herein by reference in its entirety.

Figure 5A:
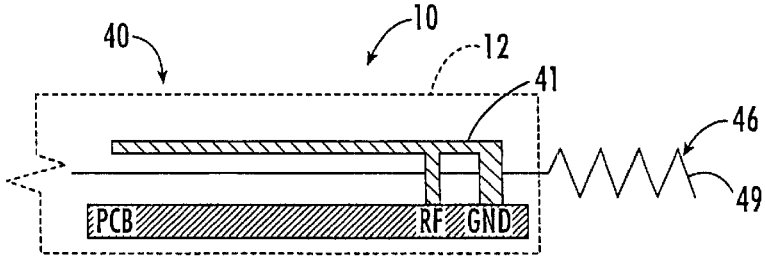
FIG. 5A illustrates the internal inverted-F antenna and retractable second antenna of the antenna system of FIGS. 4A–4B relative to a housing of a wireless communicator, wherein the retractable second antenna is in a retracted position.
Figure 5B:
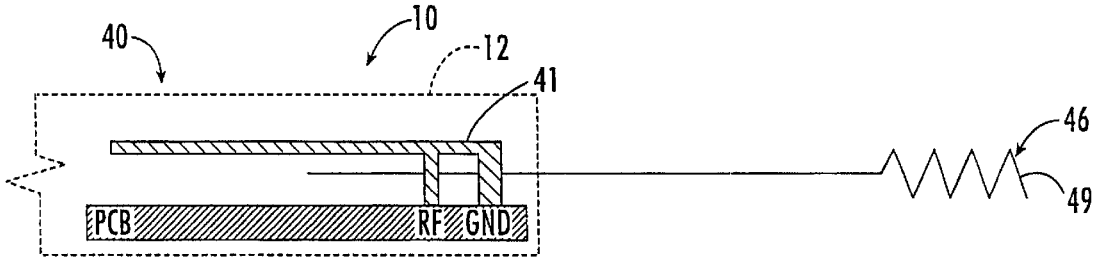
FIG. 5B illustrates the internal inverted-F antenna and retractable second antenna of the antenna system of FIGS. 4A–4B relative to a housing of a wireless communicator, wherein the retractable second antenna is in an extended position.

Referring now to FIGS. 5A–5B, the antenna system 40 of FIGS. 4A–4D is illustrated relative to a housing 12 of a wireless communicator, such as a radiotelephone 10. The inverted-F antenna 41 is disposed within the housing 12 of the radiotelephone 10 and the retractable, second antenna 46 is movably mounted within the housing 12 and is movable between a retracted position (FIG. 5A) and an extended position (FIG. 5B) through an aperture (not shown) in the housing 12.

Antenna systems according to the present invention may be particularly well suited for use within wireless communicators, such as radiotelephones, wherein space limitations may limit the performance of internally mounted antennas. The combination of a retractable, second antenna with an internal inverted-F antenna according to embodiments of the present invention can enhance the performance of internal inverted-F antennas.

Antenna systems 40 according to other embodiments of the present invention may incorporate antennas having various different configurations and orientations. As described above, an internally disposed inverted-F antenna may have various shapes and configurations. In addition, a retractable, second antenna may have various configurations, and is not limited to the illustrated configuration.

Figure 6:
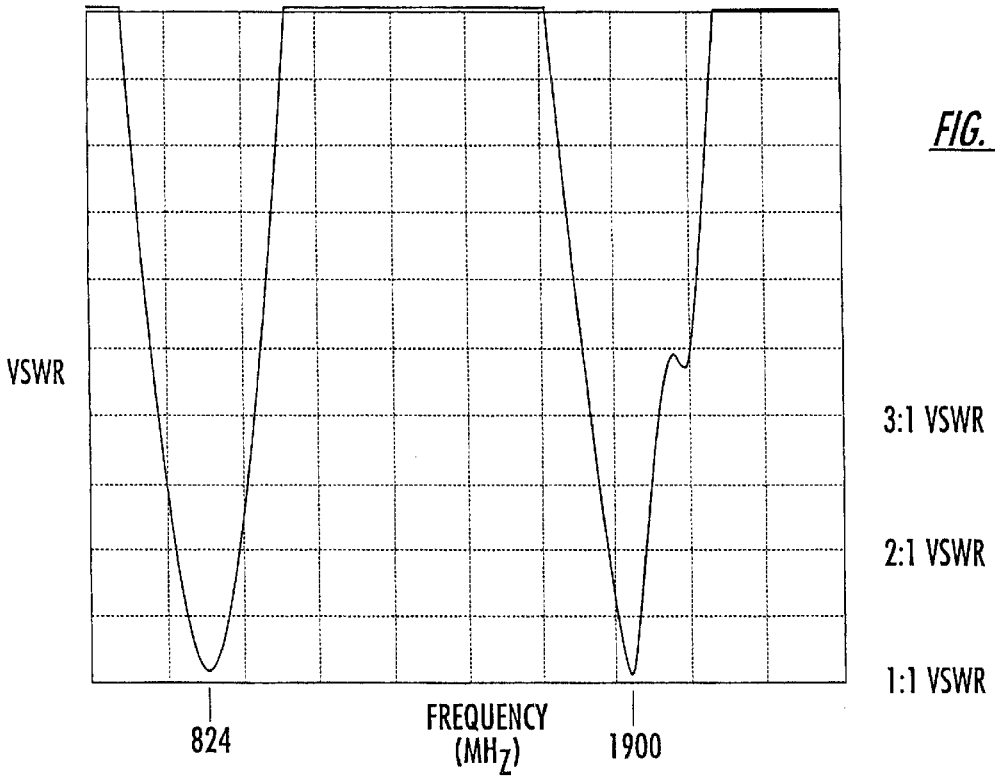
FIG. 6 is a graph of the VSWR performance of the antenna system of FIGS. 4A–4D wherein the retractable, second antenna is in an extended position.

Referring now to FIGS. 6–9, graphs of the VSWR performance of the antenna system 40 of FIGS. 4A–4D are illustrated. FIG. 6 is a graph of the VSWR performance of the antenna system of FIGS. 4A–4D wherein the retractable, second antenna is in an extended position. The antenna system represented by the graph of FIG. 6 resonates around a first central frequency of about 824 MHz and around a second central frequency of about 1900 MHz.

Figure 7:
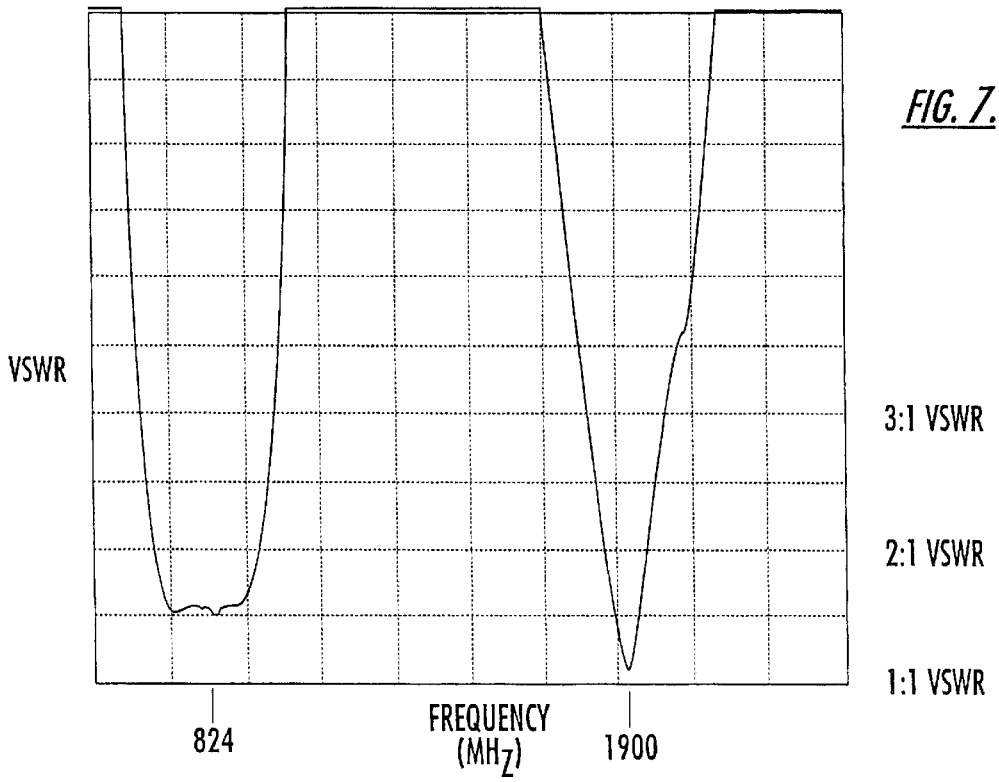
FIG. 7 is a graph of the VSWR performance of the antenna system of FIGS. 4A–4D wherein a wireless communicator incorporating the antenna system is adjacent a user's head, and wherein the retractable, second antenna is in an extended position.

FIG. 7 is a graph of the VSWR performance of the antenna system of FIGS. 4A–4D wherein a wireless communicator incorporating the antenna system is adjacent a user's head, and wherein the retractable, second antenna is in an extended position. The antenna system represented by the graph of FIG. 7 resonates around a first central frequency of about 824 MHz and around a second central frequency of about 1900 MHz. As illustrated, the user's head does not significantly reduce the performance of the antenna system.

Figure 8:
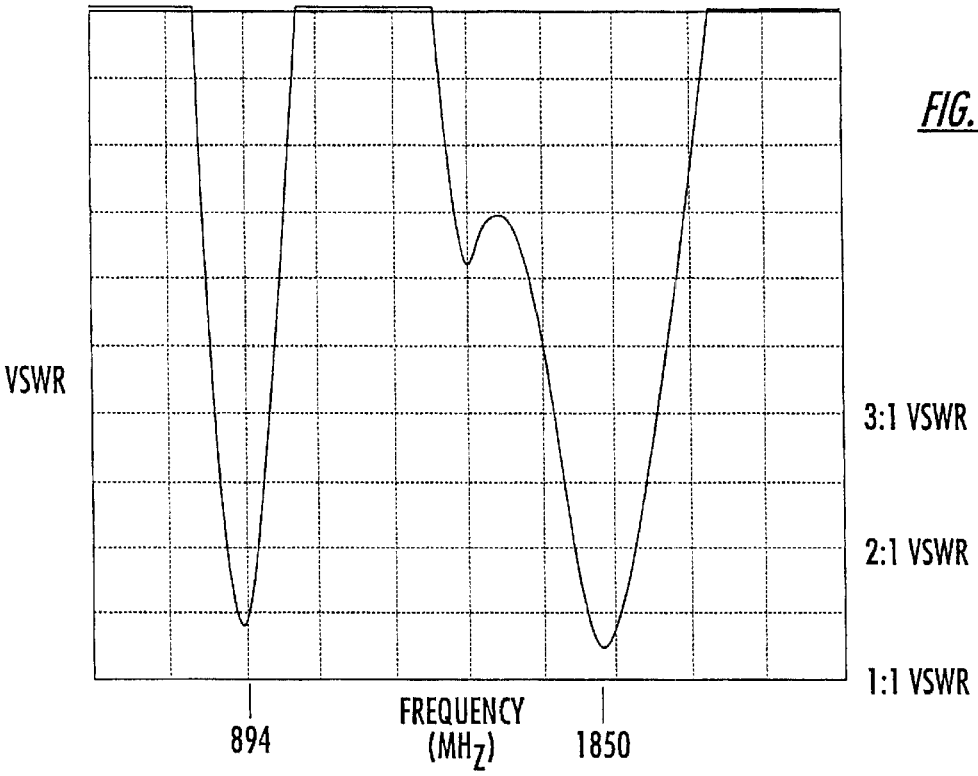
FIG. 8 is a graph of the VSWR performance of the antenna system of FIGS. 4A–4D wherein the retractable, second antenna is in a retracted position.

FIG. 8 is a graph of the VSWR performance of the antenna system of FIGS. 4A–4D wherein the retractable, second antenna is in a retracted position. The antenna system represented by the graph of FIG. 8 resonates around a first central frequency of about 894 MHz and around a second central frequency of about 1850 MHz.

Figure 9:
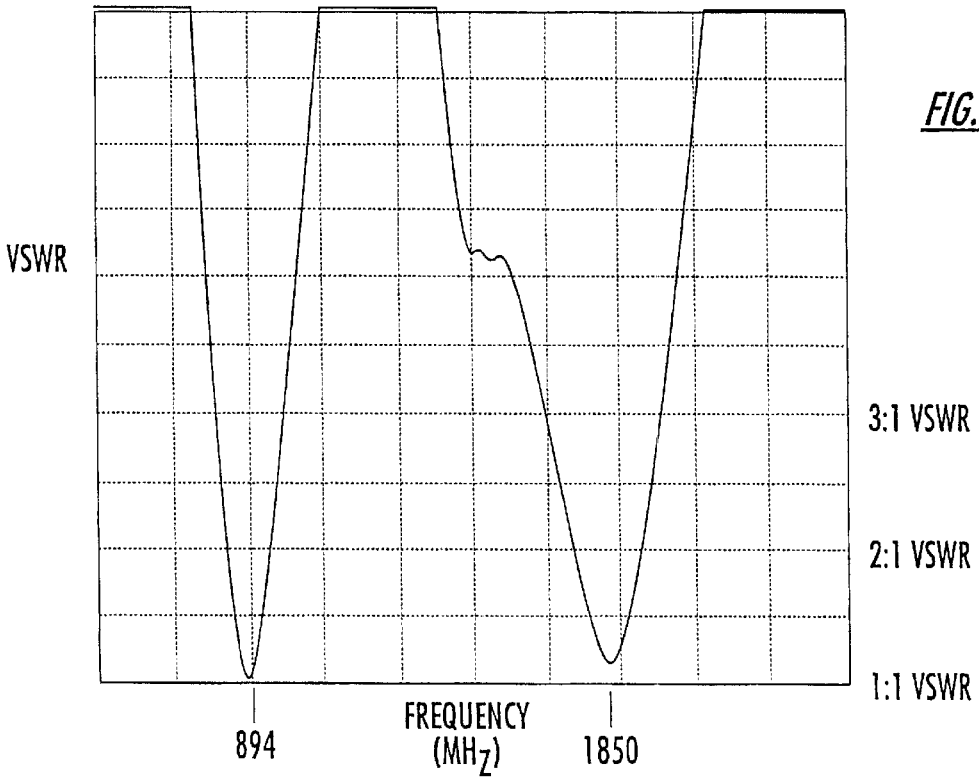
FIG. 9 is a graph of the VSWR performance of the antenna system of FIGS. 4A–4D wherein a wireless communicator incorporating the antenna system is adjacent a user's head, and wherein the retractable, second antenna is in a retracted position.

FIG. 9 is a graph of the VSWR performance of the antenna system of FIGS. 4A–4D wherein a wireless communicator incorporating the antenna system is adjacent a user's head, and wherein the retractable, second antenna is in a retracted position. The antenna system represented by the graph of FIG. 9 resonates around a first central frequency of about 894 MHz and around a second central frequency of about 1850 MHz. As illustrated, the user's head does not significantly reduce the performance of the antenna system.

It is understood, however, that the frequency bands within which antenna systems according to embodiments of the present invention may resonate may be adjusted by changing the shape, length, width, spacing and/or configuration of one or more conductive elements of the internal inverted-F antenna and/or the shape, size, and/or configuration of the retractable, second antenna. It is understood that antenna systems according to embodiments of the present invention may be utilized as single frequency band antenna systems. The present invention is not limited to multiple-frequency band antenna systems.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A wireless communicator, comprising:

a housing configured to enclose at least one of a receiver that receives wireless communications signals and a transmitter that transmits wireless communications signals;

a ground plane disposed within the housing;

an inverted-F antenna disposed within the housing, wherein the inverted-F antenna is resonant within one or more frequency bands, wherein the inverted-F antenna comprises:

a conductive element in adjacent, spaced-apart relationship with the ground plane, wherein the conductive element comprises an elongated edge that defines a first direction, and an elongated gap that extends from the elongated edge in a second direction that is transverse to the first direction;

a signal feed extending from the conductive element, wherein the signal feed is configured to electrically connect the conductive element to the at least one receiver and transmitter; and a ground feed extending from the conductive element adjacent the signal feed and electrically grounding the conductive element; and a retractable antenna that is movable between a retracted position and an extended position external to the housing, wherein the retractable antenna is directly connected with the inverted-F antenna when the retractable antenna is in the extended position, wherein the retractable antenna electrically couples with the inverted-F antenna so as to enhance one or more of the resonant frequency bands of the inverted-F antenna, wherein the retractable antenna is movable along the second direction in spaced-apart relationship with the gap such that the retractable antenna does not traverse the gap.

2. The wireless communicator according to claim 1, wherein the ground plane comprises a printed circuit board (PCB).

3. The wireless communicator according to claim 1, wherein the ground plane comprises a shield can disposed within the housing.

4. The wireless communicator according to claim 1, wherein the retractable antenna comprises an elongated rod having a free end and a helix antenna element at the free end.

5. The wireless communicator according to claim 1, wherein the retractable antenna is parasitically coupled with the inverted-F antenna when the retractable antenna is in the extended position.

6. The wireless communicator according to claim 1, wherein the inverted-F antenna is resonant within first and second frequency bands and wherein the retractable antenna electrically couples with the inverted-F antenna so as to enhance one of the first and second frequency bands.

7. The wireless communicator according to claim 1, wherein the wireless communicator comprises a radiotelephone.

* * * * *